United States Patent [19]

Watanabe

[11] 4,044,928

[45] Aug. 30, 1977

[54] CLOTHES HANGER PARTICULARLY FOR SKIRT, SLACKS AND THE LIKE

[76] Inventor: Kenji Watanabe, No. 3-6, 3-chome, Midorigaoka, Kokurakita, Kitakyushu, Japan

[21] Appl. No.: 648,896

[22] Filed: Jan. 14, 1976

[30] Foreign Application Priority Data

Apr. 26, 1975 Japan ..... 50-57294

[51] Int. Cl.[2] ..... A47J 51/142

[52] U.S. Cl. ..... 223/96; 24/67.5; 24/137 A; 24/255 R

[58] Field of Search ..... 223/91, 96, 93; 24/255 G, 255 A, 255 GC, 255 GP, 252 DP, 137 A, 67.5

[56] References Cited

U.S. PATENT DOCUMENTS

| | | | |
|---|---|---|---|
| 2,002,001 | 5/1935 | Beard | 24/255 A |
| 2,525,985 | 10/1950 | Weymouth | 24/137 A |
| 2,828,898 | 4/1958 | Hulett | 223/96 |
| 3,135,034 | 6/1964 | Fauteux | 24/137 A |
| 3,464,605 | 9/1969 | Apel | 223/96 |
| 3,923,213 | 12/1975 | George | 223/96 |
| D. 175,169 | 7/1955 | Jacobson | 223/96 |

FOREIGN PATENT DOCUMENTS

| | | | |
|---|---|---|---|
| 39,664 | 5/1965 | Germany | 223/92 |

*Primary Examiner*—George H. Krizmanich
*Attorney, Agent, or Firm*—McGlew and Tuttle

[57] ABSTRACT

Disclosed is an improved clip type clothes hanger particularly for skirt, slacks and the like which is characterized in that it essentially comprises three parts, a main body, pressure spring, and a hook, the main body being in the form of a reversed U-shape, and having lugs formed on upper side portions thereof, lower end portion of the main body being bent to form claws for clipping a skirt, slacks and the like, the pressure spring being elastically arranged between the lugs to push them outward, and thus by pushing the lugs inwardly the claws can be loosened to receive or relieve clothes.

3 Claims, 6 Drawing Figures

CLOTHES HANGER PARTICULARLY FOR SKIRT, SLACKS AND THE LIKE

This invention relates to an improved clip type clothes hanger particularly for hanging such clothes as skirt, slacks and the like. Conventional clip type clothes hangers have been very complicated in construction and thus very expensive, say, more than twice as compared with usual hangers since there are required easy operation and strong clipping effect while closure.

An object of this invention is to provide an improved, handy clip type clothes hanger which is easy in manufacture and simple in construction and thus very inexpensive while having strong clipping effect by employment of a plastic plate and a pressure spring. The clip type clothes hanger of this invention characteristically comprises three parts, the first, a main body sectionally in the form of a reversed U-shape synmetrically bent at its curved portion and having lugs formed on and extending upward from each upper portion of thus bent side portions, the second, a pressure spring elastically arranged between the lugs to push them outward, and the third, a hook either formed in an extention of one of the lugs or having its globular lower end supported between the curved portion. The lower ends of the side portions are bent inward to form claws for firmly clipping a skirt, slacks and the like therebetween. Since the pressure spring is replaceable, the clothes hanger of this invention can be used semipermanently unless other essential parts are completely broken.

Further, such operational simplicity of this hanger that just pressing the upper portions of the lugs inwardly energizes the claws to open enables users of the hanger to easily operate it without any knowledge of how to use. Moreover, clipping effect of the hanger can be further enlarged by forming a waved groove on each abutting face of the claws and thus providing more effective friction between the claws and the skirt, slacks and the like inserted thereto.

The present invention will be described in further detail by way of the preferred embodiments with reference to the accompanying drawings, in which.

Figure 1:
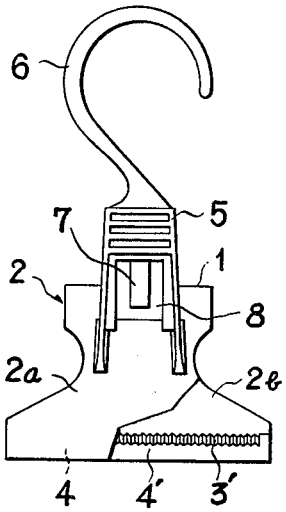
FIG. 1 is a front view showing one embodiment of a clothes hanger in accordance with the present invention.
Figure 2:
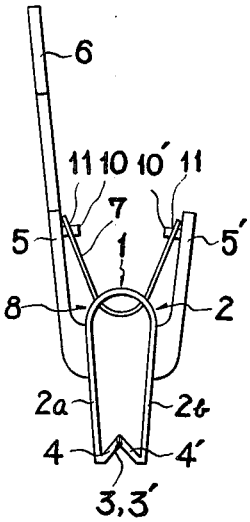
FIG. 2 is a side view of the clothes hanger.
Figure 3:
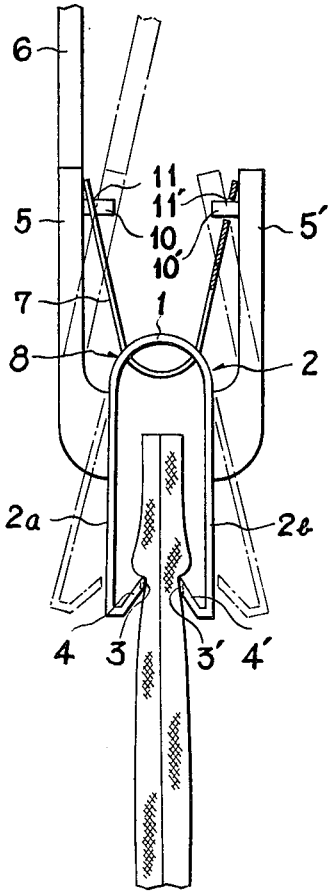
FIG. 3 is an enlarged side view showing the hanger with clothes clipped thereby.

Referring now to the drawings and in particular to FIGS. 1–3, there is illustrated a compact clothes hanger made in accordance with the present invention. The hanger illustrated comprises essentially three parts, the first, a main body 2 having a pair of lugs 5, 5′ formed each side thereof and extending upwardly, the second, a plate spring 7 and, the third, a hook 6 per se integrally formed with the lug 5. As shown in FIG. 2, the main body 2 per se made of a plastic material is sectionally in the form of a reversed U-shape synmetrically bent at a curved portion 1 thereof. Each lower end of side portions 2*a*, 2*b* of the U-shaped main body 2 constitute clipping portions which are bent inward at acute angle to form claws 4, 4′. The claws 4, 4′ are normally abutted closely each other so as to firmly clip clothes inserted therebetween. As apparent from FIG. 1, the side portions 2*a*, 2*b* are formed broader than the curved portion 1. On each abutting face of the claws 4, 4′ is formed a waved groove 3, 3′. Each inner side of the upper portion of the lugs 5, 5′ is provided with projection 10, 10′ for supporting the plate spring 7. On the center of the curved portion 1 in the main body 2 is formed an aperture 8 of such size as sufficient to freely accommodate the plate spring 7. The plate spring 7 which is provided at each end with setting holes 11, 11′ is bent U-shapedly and set on the projections 10, 10′ of the lugs 5, 5′. Thus, the plate spring 7 pushes the lugs 5, 5′ outwardly, which in turn energize the side portions 2*a*, 2*b* of the main body 2 and thus the claws 4, 4′ to abut closely each other.

One of the lugs 5, 5′ extends upwardly to form a hook 6 which is used to hang the clothes hanger of this invention upon a peg or pole (not shown). By pushing the lugs 5, 5′ inward to overcome the pressure of the plate spring 7, the claws 4, 4′ are so loosened that a skirt, slacks or the like can be easily inserted thereto or withdrawn therefrom.

Figure 4:
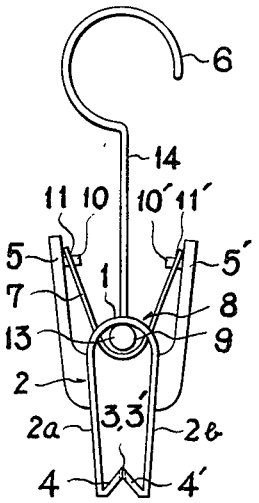
FIG. 4 is a side view of a modified embodiment of the hanger wherein a hook is installed pivotably.
Figure 5:
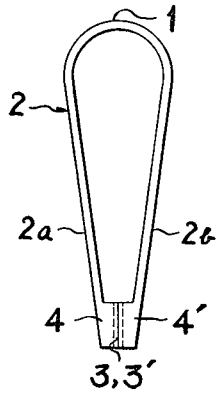
FIG. 5 is a side view of a modification in the clip portion of the hanger.
Figure 6:
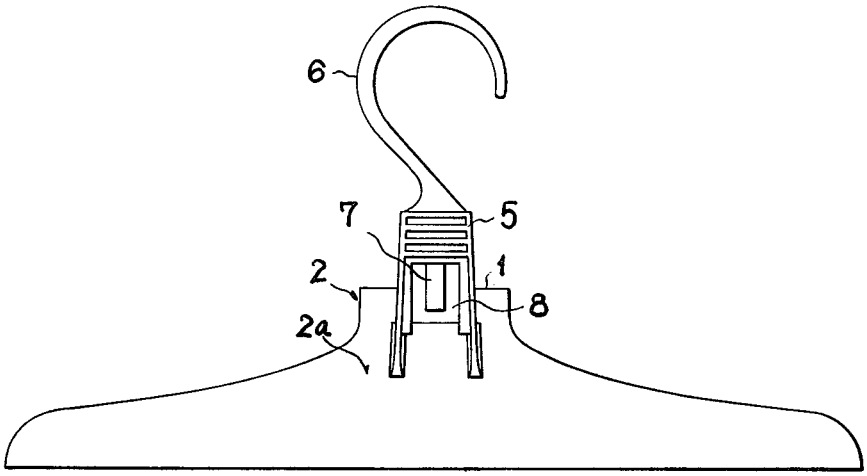
FIG. 6 is a front view of another embodiment of the hanger.

Referring to FIG. 4, there is illustrated another embodiment of the present hanger in which a modified shape of hook 6 is employed. The stem 14 of the hook 6 is made globular at its lower end to form a stopper 13. The stopper 13 is rested upon the space between the curved portion 1 and the plate spring 7 and is freely rotatable. FIG. 5 illustrates a modified type of the main body 2 in which the side portions 2*a*, 2*b* narrow toward the lower end and the claws 4, 4′ are formed at right angle thereto. FIG. 6 illustrates a further modification of the hanger of FIGS. 1–3, in which the side portions 2*a*, 2*b* of the main body 2 are so broadened as in a conventional clothes hanger. Though there is not shown in the drawings, the plate spring 7 may be easily substituted with a coil spring which can be preferably mounted directly between both projections 10, 10′.

It will be apparent that many modifications and variations may be effected without departing from the scope of the novel concepts of the present invention.

What is claimed is:

1. A clip type clothes hanger comprising a substantially U-shaped main body having a curved central web portion and a downwardly extending first and second leg portion on respective sides of said central web portion, each leg portion having a closed gripping claw formation adjacent the lower end thereof, a first and a second lug connected to respective sides of respective said first and second leg portions and extending beyond said curved web portion upwardly on each side thereof, a projection on each said first and second lugs extending toward the respective other one of said lugs, said curved portion of said main body having a slot therein, and a U-shaped spring having a central spring web portion disposed in the slot of said main body curved portion and a spring leg portion on each side extending away from said curved portion toward a respective first and second lug and engaged with the respective projection thereon, said lugs being movable together against the biasing force of said spring to open said first and second legs.

2. A clip type clothes hanger according to claim 1, including a hanger hook formed on one of said lugs.

3. A clip type clothes hanger according to claim 1, including a separate hanger hook member having a hanger hook portion and a lower portion extending through the slot of said main body and engaged between the curved portion of said main body and said curved spring web of said spring.

* * * * *